United States Patent [19]

Villavicencio

[11] 4,347,101

[45] Aug. 31, 1982

[54] PROCESS FOR PRODUCING NEWSPRINT

[75] Inventor: Eduardo J. Villavicencio, Mexico City, Mexico

[73] Assignee: W. R. Grace & Co., New York, N.Y.

[21] Appl. No.: 210,057

[22] Filed: Nov. 24, 1980

[51] Int. Cl.[3] ..... D21C 1/02; D21C 3/26

[52] U.S. Cl. ..... 162/25; 162/28; 162/96; 162/141

[58] Field of Search ..... 162/19, 25, 141, 149, 162/241, 24, 28, 26, 96

[56] References Cited

U.S. PATENT DOCUMENTS

| | | | |
|---|---|---|---|
| 2,862,813 | 12/1958 | Birdseye | 162/149 |
| 2,913,362 | 11/1959 | Cusi | 162/25 |
| 3,238,088 | 3/1966 | Villavicencio | 162/19 |
| 3,773,610 | 11/1973 | Shouvlin | 162/25 |
| 4,152,197 | 5/1979 | Lindahl et al. | 162/149 |
| 4,235,665 | 11/1980 | Reinhall | 162/28 |
| 4,260,452 | 4/1981 | Krüger et al. | 162/25 |

OTHER PUBLICATIONS

"High Yield Bagasse Pulping Process Developed", pp. 23–24.

*Primary Examiner*—Steve Alvo

*Attorney, Agent, or Firm*—Michael J. McGreal

[57] ABSTRACT

A high quality newsprint pulp can be produced from wood or vegetable fibers by thermomechanically pulping one portion of these fibers and thermochemically pulping the remaining portion. After combining these pulps the result is a pulp which has a GE brightness of 55 to 60, an opacity of 93 to 96 percent, and a relatively high tear strength. A pulp useful for making low strength papers can be produced by solely thermomechanically pulping fiber and directly using this pulp to make such products.

12 Claims, 4 Drawing Figures

PROCESS FOR PRODUCING NEWSPRINT

This invention primarily relates to a process for producing a high quality pulp suitable for making newsprint, and more particularly to a combined thermochemical and thermomechanical process for producing such a pulp. This pulp has a GE brightness of 55 to 60 and an opacity of 93 to 96 percent. This invention also relates to a process whereby the thermomechanical pulp section can be used by itself to make a pulp suitable for producing tissue and other relatively low-strength paper products.

Most of the newsprint in the world is produced from wood fibers. This includes the use of softwoods and hardwoods. The reason is that wood derived fibers are longer and as a result can produce a stronger newsprint. Also, since the initial wood fiber is longer than vegetable derived fibers, such as bagasse, straw, reed, or the like, these can undergo a fairly vigorous pulping and bleaching to produce a newsprint having a GE brightness of 55 to 60 and an opacity of 93 to 96 percent while retaining a high strength. Bagasse, which is a typical vegetable fiber and is the most used vegetable fiber source for paper making, cannot be pulped and bleached in exactly the same manner as wood fibers and yield an acceptable newsprint. If it is so treated, the relatively shorter fibers will produce a weak newsprint paper which will produce problems in traversing standard newspaper printing presses.

However, spurred by a continually growing shortage of softwood timber, and the increasing use of sugar in parts of the world as a chemical source for the production of alcohol fuel, there has developed a need to be able to use sugar cane derived bagasse fiber for producing newsprint grade paper and other highly used paper such as tissue products. Thus, while up to this time bagasse has been used to make various types of papers such as writing and printing papers, kraft paper and corrugated board, there is a need to be able to use bagasse fiber as the fiber source for newsprint and tissue. The term "tissue" is used broadly to include personal care paper products, such as napkins, facial tissue, toilet tissue, paper towels and the like, as well as industrial towels and wipers.

The present invention, although directed primarily to techniques for processing vegetable fibers such as bagasse, can also be used for the processing of wood-derived fibers. When used for processing wood-derived fibers, less pulping liquor is required as compared with conventional pulping processes. There is also produced a pulp which is of an equivalent or higher quality than that produced by conventional wood pulping processes. However, these techniques are particularly useful for processing vegetable fibers since as discussed, these fibers are of a shorter length and generally require milder pulping conditions than those used for processing wood fibers. Therefore, although the processes and equipment disclosed in this application will be discussed with regard to bagasse, it is to be understood that with some modification, they are equally applicable to hardwood or softwood-derived fibers.

Additionally, the processes and equipment have the versatility to be used to produce pulp for making either high strength or lower strength paper products. This is accomplished by the use of a combination of thermochemical and thermomechanical pulping. When the pulp from thermochemical and thermomechanical pulping is used, it is possible to make good quality newsprint. If only a thermomechanical process is used, there results a pulp very suitable for making tissue products. For pulping bagasse the pulping process comprises starting with a well depithed and washed bagasse fiber. Preferably this has been prepared using either of the techniques set forth in U.S. Pat. No. 4,231,136 or U.S. patent application No. 150,891, or a combination of these techniques. A combination of these techniques usually consists of using the process of U.S. Pat. No. 4,231,136 at the sugar mill, and reprocessing the fiber according to the technique of U.S. patent application No. 150,891 at the paper mill. The result of these techniques is a fiber which is substantially free of pith and dirt which in part makes subsequent processing by milder treatment techniques feasible.

This depithed and washed fiber is then divided into two different portions, with one portion being thermochemically pulped and the other portion being thermomechanically pulped. Each is processed in a separate two-stage digester. Each two-stage digester is similar to that set forth in U.S. Pat. No. 3,238,088. The prime difference in the thermochemical digester and the thermomechanical digester (other than in the use of chemicals) resides in the fact that the fiber traversing the thermomechanical digester is refined between the two stages of the digester, while for the thermochemically processed fiber there is no refining between the two digester stages. After digestion, the thermochemical fiber and the thermomechanical fiber each undergo separate hot refining, washing, and screen cleaning operations. The thermomechanical pulp will also undergo a disc refining before washing, while the thermochemical pulp will undergo a bleaching after washing and screening. The two pulps are then combined to produce a newsprint pulp having the characteristics to yield a high quality newsprint. If it is desired to produce a lower grade pulp, only the pulp from the thermomechanical line is used.

The prime advantage offered by the present invention is the versatility in the types of pulps which can be produced from the same equipment. That is, if it is desired to make a newsprint pulp, both the thermochemical and thermomechanical pulping lines are utilized and the pulp products of each line are mixed to yield a pulp suitable for making newsprint. However, if demand for newsprint is low, the thermomechanical pulping line can still be used to make a pulp suitable for producing tissue and other lower-strength paper products. That is, this line alone can be run independent of the thermochemical line to product tissue grade pulp.

This process will now be discussed in more detail with reference to the following drawings.

Figure 1:
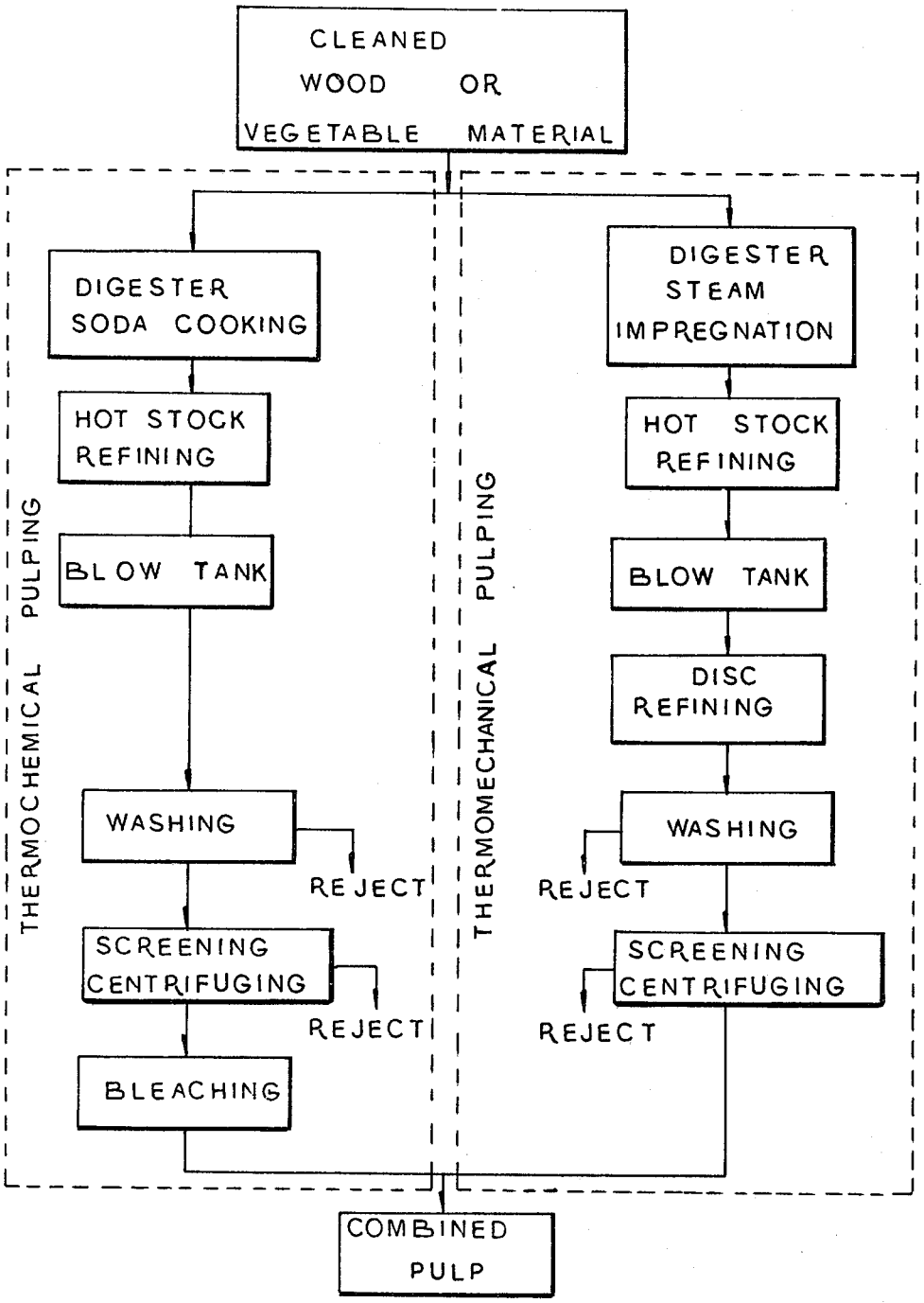
FIG. 1 is a block diagram schematic of the subject process.

The process and the associated equipment will now be described with reference to the drawings. FIG. 1 sets out schematically the stepwise processes for producing a high quality newsprint pulp using bagasse or wood as the fiber source and also for producing a lower strength pulp, such as a tissue grade pulp from wood or bagasse. The process for producing a newsprint pulp consists of thermochemically processing one portion of wood chips or depithed and washed bagasse, thermomechanically processing a second portion of wood chips or bagasse, and combing the two resulting pulps to make a high strength paper. If it is only desired to make a tissue grade of pulp, that is a pulp which will yield a lower strength paper, a solely thermomechanically processed fiber is used. This ability to produce either a newsprint pulp or a tissue grade pulp results in many efficiencies. For instance, when the paper-milling part of the plant is not producing newsprint, it can be used to make other products. This results in more efficient use of the back end of the mill which contains expensive machinery. That is, since part of the newsprint pulp line can be used to make tissue grade and other pulps, this equipment can be more heavily utilized resulting in a lower unit product cost.

When the feed to the process is to be bagasse, this should be in a well depithed and washed condition. As previously pointed out, this can be produced using the systems and equipment set forth in U.S. patent application No. 150,891 and/or U.S. Pat. No. 4,231,136. Preferably, a combination of these systems are used. In this regard the disclosures of these patent references are incorporated by reference. Of course, other systems which would produce an equivalently depithed and washed bagasse can be used.

With particular reference to FIG. 1, the thermochemical processing line consists of six steps. When a newsprint grade pulp is to be produced, about 50 to 75 percent by weight (bone dry basis) of the prepared fiber source is fed to this line, with the remainder being fed to the thermomechanical line. More material is fed to the thermochemical line since this is a harsher processing resulting in greater fiber losses. The portion of fiber which is to be thermochemically processed is first conveyed to and into a digester. Although many types of digesters can be used, it is preferred to use a digester of a type similar to that of U.S. Pat. No. 3,238,088. The preferred thermochemical digester is a two-tube digester as more particularly illustrated in FIG. 3, with the fiber being conveyed through each tube by means of a rotating screw. The speed of rotation of the screws in each chamber will determine the residence time of the fiber in each tubular chamber. The fiber is metered into the first tubular chamber with the alkaline cooking liquor and steam added to the fibers as they enter the first tubular chamber. The alkaline cooking liquor can be an aqueous sodium hydroxide solution, an aqueous solution of sodium hydroxide and sodium sulfite, or a kraft liquor such as a solution of sodium hydroxide and sodium sulfide. If needed, additional steam is added at various points in the first tubular chamber.

The necessary residence time of the fiber in each tube of the digester will depend on the processing conditions and the input material. However, in the usual case, the fiber will be in this digester (both tubes) for a total of about 10 minutes to 60 minutes. The temperature of the digester is maintained at about 140° C. to 190° C., which results in a pressure of about 5 to 10 kg/sq. cm. This temperature and pressure will vary through the digester since the steam (heat and pressure source) is added at the input end of the digester. The lowest temperature and pressure will be at the fiber exit end of the second tubular chamber. The cooking liquor to fiber ratio (bone dry basis) is in the range of 3.5 to 4.5 to 1.

When sodium hydroxide alone is used for digestion, a percent by weight solution is used. This has a Ph of 14. The preferred sulfite cook liquor consists of a molar ratio of sodium sulfite to sodium hydroxide of about 3 to 1. This results in a liquor having a Ph of about 10.8 to 11. A typical kraft liquor which can be used consists of sodium sulfide and sodium hydroxide in a molar ratio of about 2 to 1. Such a liquor would have a sulfidity factor of about 2 to 1.

After the fiber exits the digester, it enters a refiner. Since this refining is at elevated temperatures and pressures, it is designated as hot stock refining. This refining step at elevated temperature and pressure opens up fiber bundles which had been partially, but not fully, opened during digestion. Any commercially available refiner can be used in this step. After hot stock refining, the fibers enter the blow tank where the pressure on the fibers is reduced to atmospheric levels. This rapid reduction in pressure results in part of the moisture content of the fibers being rapidly converted to steam and the fiber temperature rapidly dropping to about 100° C. This blow down, therefore, further serves to separate the individual fibers by using this trapped expanding steam.

In the next step, the fibers undergo a three-stage countercurrent wash to remove the cooking liquor and foreign materials such as dirt and the like. In this countercurrent wash, fresh or mill water enters the third stage and flows to the first stage while the fibers flow from the first to the third stage. In this scheme, the cleanest wash water contacts the cleanest fiber. After washing the fibers are screened in two stages to remove any large fiber bundles which have not been opened. These fibers are recycled to the input to the digester or for further depithing. Part of the screening process consists of centrifuging the fibers to remove dirt and excess liquid. After centrifuging, the fibers are ready for bleaching.

The bleaching step can be an oxidative or reductive bleaching. A typical oxidizing bleachant is sodium hypochlorite. Typical reducing bleachants are hydrogen peroxide, sodium peroxide, or zinc hydrosulfite. A bleachant such as sodium hypochlorite removes lignin and requires a washing after bleaching. This can be a fresh or mill water wash. A peroxide bleachant does not require a washing since it attacks color bodies and does not remove lignin. However, if desired a water or mill wash can be used. During bleaching the fiber is in a slush consistency (about 10% fiber on a dry basis). The bleachant is added so as to be in a concentration of about 5 to 20 percent by weight of the water concentration and usually about 10 percent. When a peroxide such as hydrogen peroxide is used, it is useful to add a small amount of nitrilotriacetic acid or ethylene diamine tetraacetic acid to chelate iron and other metal ions which decompose peroxide. The pulp is sufficiently bleached when it has a G.E. brightness of 60 to 65. Such a pulp is then in a condition for mixing with a thermomechanical pulp.

The thermomechanical pulping line uses a digester similar to that of the thermochemical line, except that between the first tubular chamber and the second tubular chamber, there is a hot stock refiner. This refiner serves to break down larger fiber bundles which have been softened in the first tubular digester. That is, there is a hot refining mid-point between each stage of digestion. This digester is set forth in FIG. 2 and will be more fully described herein. Steam at 2 to 5 kg/sq. cm and 120° C. to 140° C. is added to the fibers as they enter the first tubular chamber of the two-tube digester. More steam can be added to the fiber in this first tube. A rotating screw conveys the fibers through each tubular chamber. At the exit end of the first tubular chamber, the fibers pass through the hot stock refiner by means of about a 1 kg/sq. cm pressure drop maintained across the refiner. After refining the fiber passes into the second tubular chamber and is further digested at the lower pressure and corresponding temperature. The fiber leaves this second tubular chamber and at the same temperature and pressure undergoes another hot stock refining. This is substantially no pressure drop across this refiner. This refiner serves to break up fiber bundles which were softened in the second tubular digester. This refined fiber then goes to blowdown where the pressure drops to atmospheric pressure and the fiber temperature to about 100° C. During fiber blowdown, the expanding steam serves to explosively separate the fibers. The fibers then undergo a disc refining which is a mild refining compared to the hot stock refining. This refining further serves to break bundles into the individual fibers. The refined fiber then undergoes a single stage of washing using either mill water or fresh water, and is screened and cleaned in the same manner as the thermochemically produced pulp was screened and cleaned after washing. The rejects from the washing step which are primarily short fibers, and the rejects from the screening and centrifuging step, which are primarily dirt and rock, are discarded.

At this point, this thermomechanical pulp can be used directly to make lower strength papers such as tissue grade products, or it can be bleached using a peroxide bleachant and used to make such products. If such a bleachant is used it would be used in the same concentrations and in the same manner as used in bleaching the thermochemical pulp. Such a bleaching would serve to further whiten the paper.

The other principal use for this thermomechanical pulp is to combine it with a batch of the foregoing thermochemical pulp to form a newsprint pulp. In such an instance, from 30% to 70% by weight (dry weight) of thermomechanical pulp is mixed with 70% to 30% by weight of the thermochemical pulp. Since the thermomechanical pulp is the lower cost pulp, it is desirable to combine as large amount of this pulp with the thermochemical pulp. The limiting factor as to the ratio of one pulp to the other is that the overall mixture must have a G.E. brightness of 55 to 60, and an opacity of 93% to 96%. Also, the pulp has to be capable of producing a newsprint having a tear strength index greater than 31.

Figure 2:
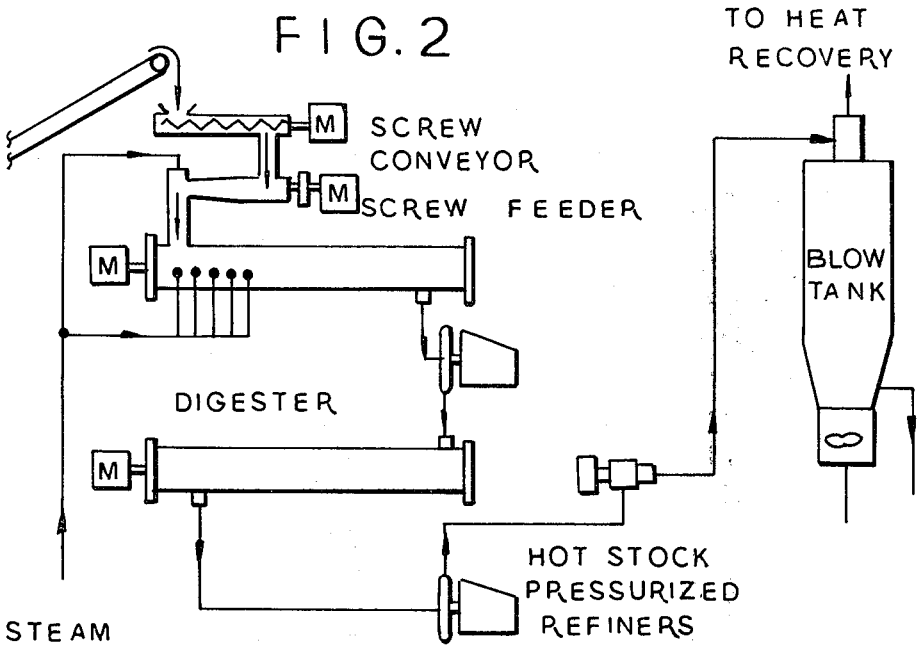
FIG. 2 is a two-dimensional diagram of the thermomechanical digester.

FIG. 2 is a schematic illustration of the thermomechanical digester. The fibrous material is conveyed by a standard conveyor belt arrangement into the screw conveyor which fees the fibrous material to the screw feeder. M designates the motors which drive the screw conveyor and the screw feeder. The screw feeder feeds the fibrous material into the first tubular chamber of the digester. This digester consists of two tubes interconnected through a hot stock pulp refiner. There is a pressure drop of about 10 to 20 psia across this refiner. The pressure and temperature in each tubular chamber of the digester is provided by the steam fed into the first tubular chamber. Each tubular chamber contains a rotating feed screw which transports the fibrous material from the input end to the exit end. The separate motors M rotate each feed screw. The rotation speed of each screw will determine the residence time of the fiber in each tubular chamber. Upon exiting the second chamber of the digester, the digested fiber is refined with little or no pressure drop, and pumped to the blow tank. In the blow tank the pressure is reduced to the prevailing ambiant pressure and the fiber temperature to about 100° C. The steam released in this step is recovered for reuse.

A prime feature of this digester is utilizing a refiner in the transfer line between the first and second tubular chambers of the digester, and in particular the use of a 10 to 20 psia pressure drop across the refiner. The pressure drop besides providing the motive force to propel the fiber through the refiner also serves to open the fiber bundles through a rapid vaporization of some of the fiber bundle moisture content. This intermediate refining and pressure drop significantly aids in separating the fibers.

Figure 3:
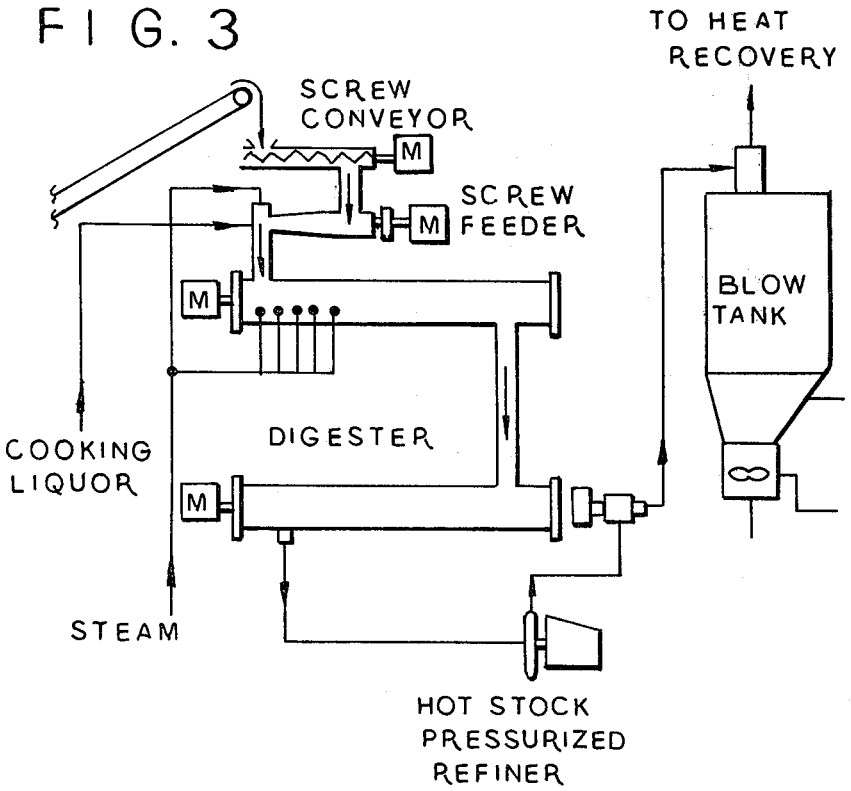
FIG. 3 is a two-dimensional diagram of the thermochemical digester.

FIG. 3 is a schematic illustration of the thermochemical digester. This is essentially identical to the thermomechanical digester set forth in FIG. 2, with the differences being the provision of an inlet for cooking liquor prior to the fibrous material entering the digester and the deletion of the refiner between the tubular digestion chambers. Otherwise, the thermochemical digester is essentially the same as the thermomechanical digester.

Both the thermomechanical and thermochemical digesters use conventional pumps, piping, motors, conveyors, refiners, and the like. These need only be sized to the needs of a particular installation. The tubular digesters can be of any reasonable size. Usually these digesters are about 2 to 10 meters in length, with an internal diameter of about 0.2 to 2 meters. The walls of the various equipment and the piping should be of a strength to withstand pressures of at least 500 psia. All construction materials should be of a type suitable for use in corrosive environments.

Figure 4:
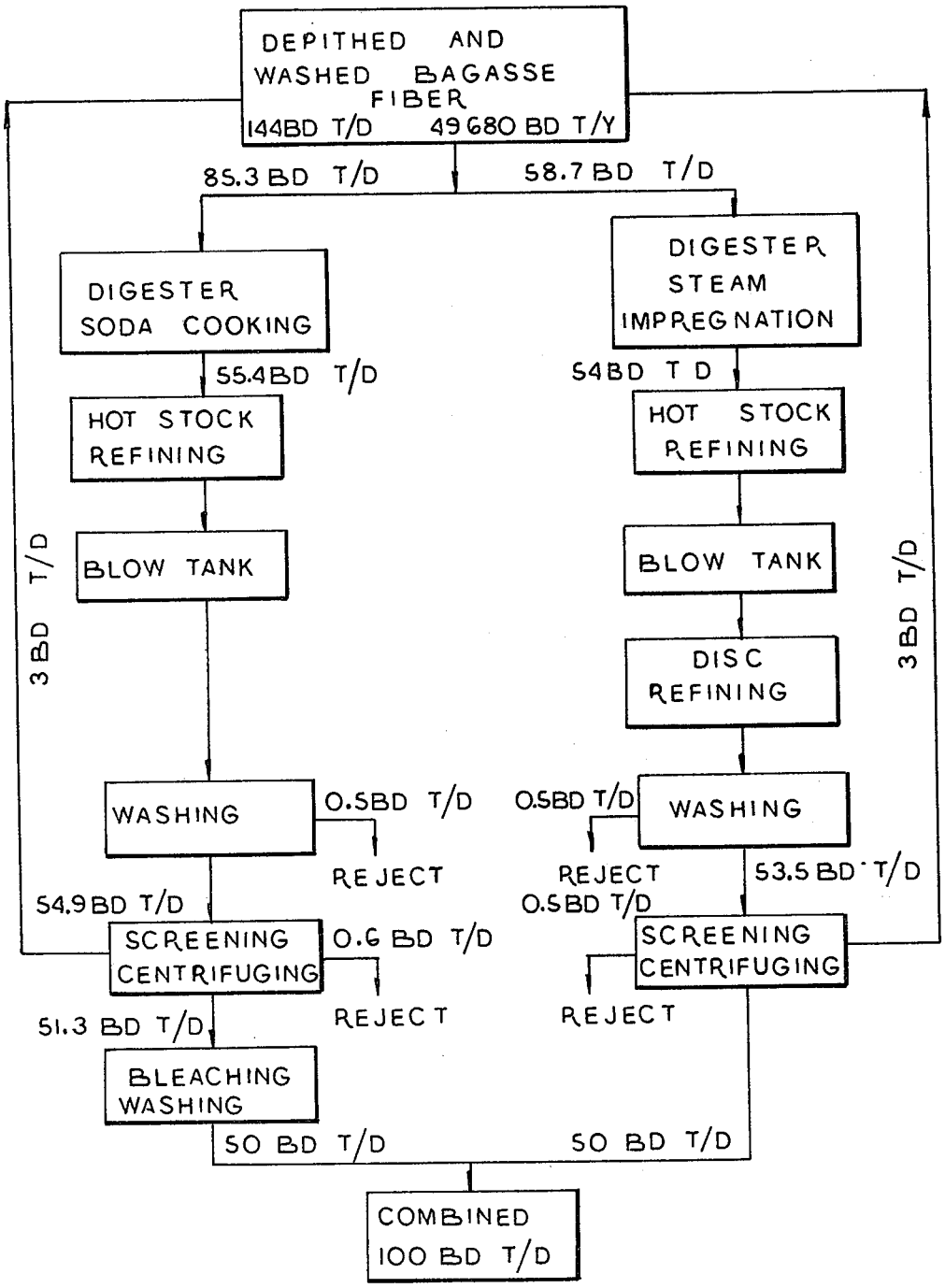
FIG. 4 is a material balance diagram for a 34,500 ton per year (bone dry basis) bagasse pulp mill.

FIG. 4 sets forth the typical material balance for a bagasse pulp mill designed to produce 100 bone dry tons/day of a newsprint pulp. Operating 245 day/year this pulp mill will produce 34,500 bone dry tons/year of pulp. These values are given in bone dry terms as a point of reference, it being understood that the pulp is a fiber water mixture suitable for application onto the moving wire of a paper making machine.

This material balance has been designed so that the thermochemical and the thermomechanical lines each yield 50 bone dry ton/day of pulp. This mix can be varied to suit particular feedstocks and desired end product pulp. That is, if the feed fiber is longer than that normally used, the amount of lower cost thermomechanically pulped fiber can be increased in the paper stock.

With particular reference to FIG. 4, 144 tons per day of a washed and depithed bagasse (bone dry basis) is fed to the system. Of this amount, 85.3 tons per day are fed to the thermochemical line and 58.7 tons per day to the thermomechanical line. The yield from the thermochemical digester will be 55.4 tons per day and that from the thermomechanical digester 54 tons per day. The losses represent removed lignin, dirt, and solubles such as residual sugar which had been carried by the fibers. There are no losses in the hot stock refiners or in the blow tanks. Heat recovered from the blow tanks is used to pre-heat process water.

In the washing steps, various foreign material is removed at the rate of about 0.5 tons per day from each pulp. The wash rejects consist of some short fibers and foreign material such as rock or dirt. It is also during this wash that the pulping chemicals are removed from the thermochemical pulp. Since in the thermochemical line chemicals are also removed, a three-stage countercurrent washing is used. This three-stage process consists of flowing the fiber from the first stage to the third stage and the and the wash water from the third stage to the first stage. The wash water is a mill water from the subsequent paper making operation. In the next step both the thermochemical and thermomechanical pulps are screened and centrifuged. In this operation about three tons per day of fiber agglomerates are recycled from each pulping line to the fiber input into the system. These recycled agglomerates are then reprocessed. The rejects from this step of the processing consist essentially of various kinds of foreign material.

After centrifuging and screening, the thermomechanical pulp is ready for use, although it may optionally be bleached using a peroxide if necessary. The thermochemical pulp is bleached using sodium hypochlorite to remove additional lignin and to whiten the fiber. This is a more severe bleaching than a peroxide bleaching and results in a fiber loss of about 1.3 tons per day (bone dry basis). After bleaching and washing, this thermochemical pulp is mixed with the thermomechanical pulp and is fed to papermaking. This pulp produces a good quality newsprint.

Sodium hypochlorite bleaching is conducted at about 30° C. to 40° C. The bleachant is added to provide 0.5 to 3.0 wt. percent of available chlorine based on bone dry fiber. During bleaching the fiber is in a dense slush state. When either the thermochemical or thermomechanical pulp is bleached using a peroxide, the peroxide is added to give about a 10 percent solution.

If it is desired to make a tissue grade pulp for making paper towels and the like, only the thermomechanical pulp need be used. The thermomechanical pulp produces a lower strength and higher wicking paper which is desirable in tissue applications. It is also a lower cost pulp since no chemicals were required in the processing.

I claim:

1. A method for producing a high quality newsprint pulp from wood or vegetable fibrous material comprising:

(a) providing a quantity of said fibrous material in a form suitable for input into a digester;

(b) (i) conveying at least forty percent by weight of said quantity of fibrous material to a thermochemical digester and contacting said fibrous material with an alkaline cooking liquor whereby lignin is removed from said fibrous material and said fibrous components;

(ii) after digesting said fiber for from 0.1 to 1 hour at 140° C. to 190° C., refining the digested fiber at above 100° C.;

(iii) rapidly reducing the pressure on said digested and refined fibers to approximately ambient pressure and washing and screening said fiber to remove pulping chemicals and dirt and other foreign fragments therefrom; and (iv) contacting said washed and screened fibers with a bleachant for a time sufficient to raise the GE brightness of said fibers to greater than about 60;

(c) (i) conveying the remainder of said quantity of fibrous material to a thermomechanical digester which consists of a first section and a second section, said sections being separated by a refiner;

(ii) contacting said fibrous material within the first section, of said thermomechanical digester with steam at a pressure greater than about 2 kg/sq. cm and mechanically working said fiber in said section of the digester to partially reduce said fibrous material to its fiber components;

(iii) conveying the fibrous material from the first section of said digester to a refiner and refining said fibrous material;

(iv) contacting the refined fiber in a second section of said thermomechanical digester with steam at a pressure of less than about 2 kg/cm$^2$, whereby said fibrous material is substantially reduced to its fiber components;

(v) refining the digested fiber and rapidly reducing the pressure on the digested fiber to approximately ambient pressure; and (vi) refining said digested and elevated pressure refined fibers at ambient pressure; and washing and screening the refined fibers to remove dirt and large fiber fragments therefrom;

(d) intermixing the bleached fiber from thermochemical digestion with the fiber from thermomechanical digestion; and;

(e) producing a newsprint paper from such intermixed fibers.

2. A method for producing a high quality newsprint pulp as in claim 1, wherein the thermomechanical digester consists of two interconnected tubular chambers with screw means within each tubular chamber to convey fibers from the input end to the exit end of each tubular chamber, the interconnection including a pulp refiner; the temperature in the first tubular chamber and in the second tubular chamber being about 120° C. to 140° C.; the pressure in said first chamber being reduced in said refiner to the pressure level of said second tubular chamber, the energy from the reduction in pressure in the refiner aiding to open fiber bundles.

3. A method for producing a high quality newsprint pulp as in claim 1, wherein the thermochemical digester consists of two interconnected tubular chambers with the pressure in each chamber being maintained in excess of 2 kg/sq cm.

4. A method for producing a high quality newsprint pulp as in claim 1, wherein said alkaline cooking liquor is selected from a sodium hydroxide liquor, a sodium hydroxide-sodium sulfite liquor, a sodium hydroxide-sodium bisulfite liquor, and a kraft liquor consisting of sodium hydroxide and sodium sulfide having a sulfidity of at least 30 percent.

5. A method for producing a high quality newsprint pulp as in claim 4, wherein said alkaline cooking liquor consists of an aqueous solution of sodium hydroxide having a Ph of about 14.

6. A method for producing a high quality newsprint pulp as in claim 4, wherein said alkaline cooking liquor consists of an aqueous solution of sodium hydroxide and sodium sulfite in a molar ratio of about 1:3.

7. A method of producing a high quality newsprint pulp as in claim 1, wherein said bleachant is selected from the group consisting of oxidizing and reducing bleachants.

8. A method for producing a high quality newsprint pulp as in claim 7, wherein said bleachant is hydrogen peroxide.

9. A method for producing a high quality newsprint pulp as in claim 7, wherein said bleachant is sodium peroxide.

10. A method for producing a high quality newsprint pulp as in claim 7, wherein said bleachant is an alkaline hypochlorite.

11. A method for producing a high quality newsprint pulp as in claim 7, wherein said fibrous material is bagasse.

12. A method for producing a high quality newsprint pulp as in claim 7, wherein said fibrous material is wood chips.

* * * * *

UNITED STATES PATENT AND TRADEMARK OFFICE

CERTIFICATE OF CORRECTION

PATENT NO. : 4,347,101

DATED : Aug. 31, 1982

INVENTOR(S) : Eduardo J. Villavicencio

It is certified that error appears in the above-identified patent and that said Letters Patent is hereby corrected as shown below:

In the Heading, at block [73] Assignee:

Delete "W. R. Grace & Co., New York, N.Y."
and substitute:

--Process Evaluation and Development Corp., Dallas, Tex.--.

Signed and Sealed this

Thirty-first Day of May, 1988

*Attest:*

DONALD J. QUIGG

*Attesting Officer*

*Commissioner of Patents and Trademarks*